United States Patent [19]

deKok et al.

[11] Patent Number: 4,925,457

[45] Date of Patent: May 15, 1990

[54] ABRASIVE TOOL AND METHOD FOR MAKING

[76] Inventors: Peter T. deKok, 74 Peachtree Way; Naum N. Tselesin, 2900 Lookout Pl., both of Atlanta, Ga. 30305

[21] Appl. No.: 303,924

[22] Filed: Jan. 30, 1989

[51] Int. Cl.[5] ..... B24D 3/02

[52] U.S. Cl. ..... 51/293; 51/295; 51/308; 51/309

[58] Field of Search ..... 51/293, 295, 308, 309

[56] References Cited

U.S. PATENT DOCUMENTS

| | | | |
|---|---|---|---|
| 3,402,514 | 9/1968 | Johnson | 51/293 |
| 3,906,684 | 9/1975 | Marshall et al. | 51/295 |
| 3,942,959 | 3/1976 | Markööö et al. | 51/295 |
| 4,047,902 | 9/1977 | Wiand | 51/295 |
| 4,163,647 | 8/1979 | Swiatek | 51/295 |
| 4,317,660 | 3/1982 | Kramis et al. | 51/295 |
| 4,543,106 | 9/1985 | Parekh | 51/295 |
| 4,826,508 | 5/1989 | Schwartz et al. | 51/295 |

*Primary Examiner*—Paul Lieberman
*Assistant Examiner*—Willie J. Thompson
*Attorney, Agent, or Firm*—James B. Middleton

[57] ABSTRACT

An abrasive material is formed by uniformly spacing particles of diamond or other hard, abrasive material, on a flexible carrier, embedding the particles in the carrier, and fixing the particles to the carrier with the particles protruding from the carrier to perform the abrasive action. The particles can be distributed by placing them in the openings of a mesh; and, the mesh may be removed or may be a part of the carrier. Since the carrier is flexible, the carrier can be shaped to conform to substrates of complex shapes. A plurality of carriers having different concentrations can be bonded together to form tools having varying concentrations.

10 Claims, 1 Drawing Sheet

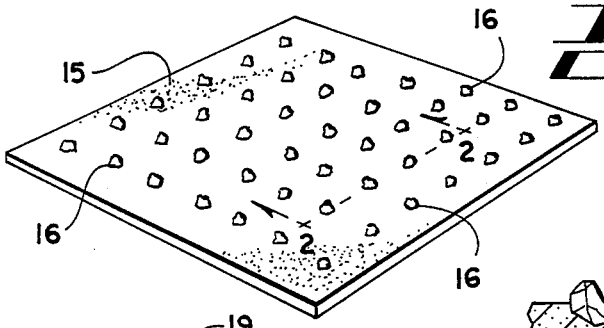
Fig_1
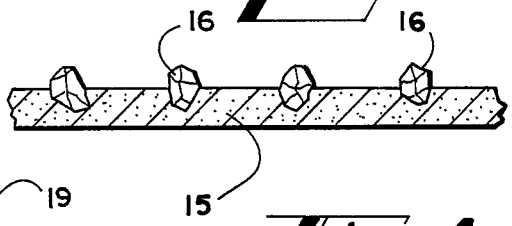
Fig_2
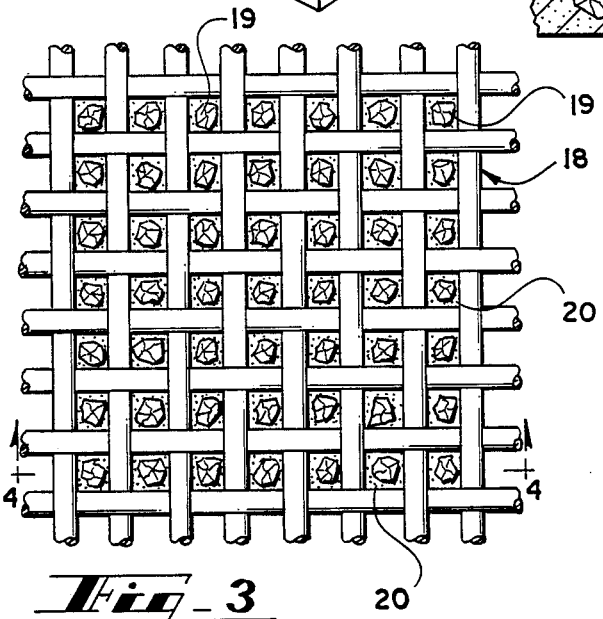
Fig_3
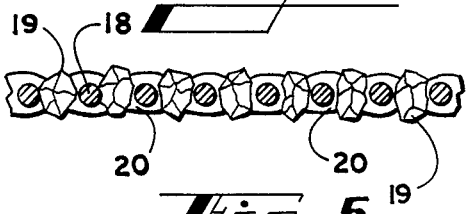
Fig_4
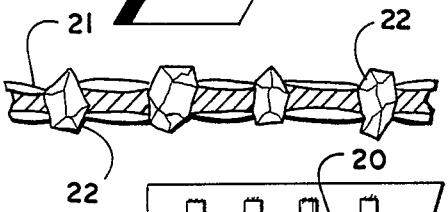
Fig_5
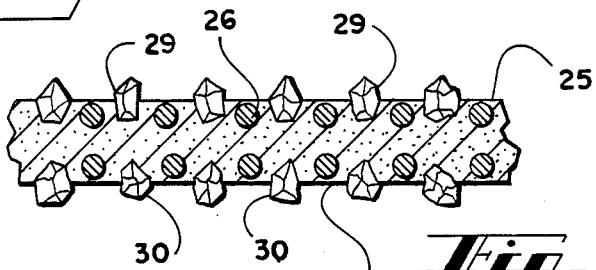
Fig_6
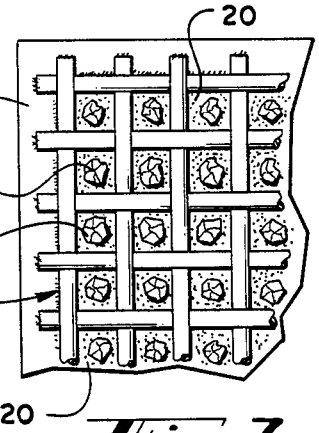
Fig_7
Fig_8
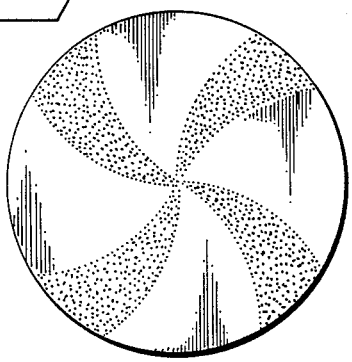
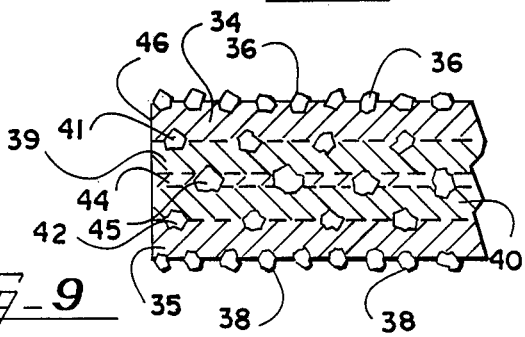
Fig_9

ABRASIVE TOOL AND METHOD FOR MAKING

INFORMATION DISCLOSURE STATEMENT

It is well known to embed diamonds and other hard substances within a matrix to provide cutting and polishing tools. Cutting tools are commonly made by placing diamond chips in a matrix material such as a metal powder or resin. The matrix material in then compressed and sintered to hold the diamond chips securely. It will be understood that this well known technique yields a product with diamonds randomly distributed therethrough, and there is little that can be done to provide otherwise.

Another technique for providing cutting or polishing tools utilizes electroplating. In general, diamond chips are placed on a metal surface, and a metal is electroplated onto the metal surface, successive layers being plated until the diamonds are fixed to the metal surface. While this technique allows the diamond to be in a regular pattern if desired, the individual stones are usually set by hand. Also, though the electroplated tools have met with considerable commercial success, such tools are somewhat delicate in that the stones are fixed to the tool only by the relatively thin layers of metal, and there can be only a single layer of diamonds to act as the cutting surface. The tool loses its shape as further layers of metal are deposited.

There have been numerous efforts to produce an abrasive tool wherein the carrier for the grit is flexible. Such a tool is highly desirable for polishing non-flat pieces, or for fixing to a contoured shaping device such as a router. The prior art efforts at producing a flexible tool have normally comprised a flexible substrate, diamonds being fixed thereto by electroplating. For example, small diamond chips have been fixed to the wires of a wire mesh, the flexible mesh providing the flexibility desired. Also, small dots of copper having diamond chips fixed thereto by electroplating have been carried on a flexible foam. The foam provides the flexibility, and the copper dots are separated sufficiently to maintain the flexibility.

The prior art has not provided a flexible cutting or abrasive tool having diamonds of a selected size firmly held in a flexible matrix, with the diamonds being easily arrangeable in a selected, regular pattern.

SUMMARY OF THE INVENTION

This invention relates generally to cutting and abrasive tools, and is more particularly concerned with a tool comprising a flexible matrix with particles fixed in the matrix in a predetermined pattern, and a method for providing such tool.

The present invention provides a flexible abrasive tool having particles of diamond or other hard substance arranged in a selected pattern and embedded in a carrier. The type of the particles and the size of the particles can be selected to yield the desired characteristics of the tool. The carrier may comprise known materials such as metal powders, metal fibers, or mixtures of metal powders and fibers; or, the carrier may comprise a wire mesh, a particle being placed within each opening of the mesh, or within selected openings of the mesh, and the particles are then fixed to the mesh. The carrier is flexible so that it can be shaped to conform to a given substrate.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a carrier having particles embedded in one surface thereof in accordance with the present invention;

FIG. 2 is an enlarged cross-sectional view taken substantially along the line 2—2 in FIG. 1;

FIG. 3 is a plan view showing particles embedded in a wire mesh;

FIG. 4 is a cross-sectional view taken substantially along the line 4—4 in FIG. 3;

FIG. 5 is a view similar to FIG. 4 but showing a modified form thereof;

FIG. 6 is a cross-sectional view illustrating another modified form of the arrangement shown in FIG. 4;

FIG. 7 is a plan view showing the carrier of FIG. 3 fixed to a tool;

FIG. 8 is a plan view, on a reduced scale, showing another form of the arrangement shown in FIG. 7; and, FIG. 9 is a cross-sectional view illustrating a composite tool made in accordance with the present invention.

DETAILED DESCRIPTION OF THE EMBODIMENTS

Referring now more particularly to the drawings, and to those embodiments of the invention here chosen by way of illustration, FIG. 1 shows a carrier 15 having a plurality of particles 16 embedded therein. Those skilled in the art will understand that it is known to use preformed structures of metal powders or metal fibers, or mixtures of metal powders and fibers. These materials are readily available, and are well known to those skilled in the art, so no further description is thought to be necessary. With such materials in mind, it will be understood that particles of a hard substances such as diamond can be placed against the carrier 15 and forced into the surface of the carrier to produce the arrangement shown in FIG. 1. After the particles have been positioned as desired, the material can be sintered, with or without pressure.

FIG. 2 of the drawings shows the structure of the device shown in FIG. 1. It will here be seen that the particles 16 have been urged into the carrier 15 sufficiently that the particles 16 are well supported. As a result, once the carrier 15 has been sintered, the particles 16 are well set and the device is a very effective abrasive.

While the carrier 15 is shown in FIGS. 1 and 2, it is known that the material is flexible; thus, the abrasive material can be formed to virtually any shape desired. Also, when the carrier 15 is placed under pressure during the sintering the density of the carrier is increased to provide a firmer hold on the particles 16.

Attention is next directed to FIG. 3 of the drawings which discloses a woven mesh 18 having a particle 19 in each opening of the mesh. The mesh 18 may be any metal, such as copper, brass or nickel. A particle of an appropriate size to fit in the openings of the mesh 18 is used; then, to hold the particles in place, metal powder or the like indicated at 20 is placed into each opening in the mesh, surrounding the particles 19. As before, the metal powder can be sintered to secure the particles 19 in place, the sintered powder 20 being attached to both the mesh 18 and the particles 19. It will also be understood that the sintered powder 20 will secure the wires of the mesh to one another. Those skilled in the art will understand that the particles can be fixed to the mesh be electroplating, gluing, or by other means if desired.

With the construction shown in FIGS. 3 and 4, the wire mesh 18 is inherently flexible; and, by placing the particle or particles in each opening in the mesh, flexibility is maintained. Furthermore, as is best shown in FIG. 4, the particles 19 can extend beyond the mesh 18 on both sides, so the material is a two-sided abrasive or cutting tool.

An alternative to the construction shown in FIGS. 3 and 4 is shown in FIG. 5. Again, there is the mesh designed at 21, and particles 22 are placed within the openings of the mesh 21. Rather than utilize the metal powder as in FIG. 4; however, one might use a mesh 21 made of a metal having a relatively low melting point. The mesh containing the particles can then be heated just until the metal of the mesh flows somewhat. Thus, it will be noted in FIG. 5 of the drawings that the metal of the mesh 21 has flowed to embrace the particles and hold the particles in position.

From the above description it will be understood that hard particles such as diamond, tungsten carbide or the like can be arranged in the desired pattern, and placed into a matrix. The matrix may take the form of a metal powder and/or metal fiber, or may take the form of a wire mesh. In either case, the particles are held in place, and the material is sintered to bond the particles permanently in position. Such materials can be formed with the particles protruding from one side as in FIGS. 1 and 2, or protruding from two sides as in FIGS. 4 and 5.

Turning now to FIG. 6, one way to arrange the particles in the desired pattern is to put the particles into the openings of a mesh, then place the mesh and particles on the carrier. The mesh can be removed, leaving the particles in the desired pattern. In FIG. 6, the same procedure is used; but, instead of removing the mesh, the mesh is urged into the carrier to become a part of the final tool.

In more detail, FIG. 6 shows a carrier 25, the carrier 25 being formed of metal powder or the like as is discussed above. There are two meshes designated at 26 and 28, one on each side of the carrier 25. In each opening of each mesh, there is a particle, the particles in mesh 26 being designated at 30. The resulting tool therefore has particles 29 and 30 protruding from both sides of the carrier, and further has the mesh 26 and 28 to lend stability to the carrier and to assist in holding the particles 29 and 30 in the carrier. The mesh 26 and 28 can be placed either completely within the carrier 25 or somewhat exposed at the surface of the carrier. The exposed mesh protects the diamonds and assists in holding the diamonds as the diamonds wear.

Another form of tool using the present invention can be made as shown in FIG. 7. FIG. 7 illustrates a mesh as shown in FIG. 3, the mesh being fixed to a substrate such as a metal plate or the like. Since the abrasive material is the same as is shown in FIG. 3, the same reference numerals are used for the same parts. It will therefore be seen that the mesh 18 has particles 19 held in place by a sintered powder 20 to provide a flexible abrasive material. This flexible abrasive material is then fixed to a metal plate 31 as by welding, brazing or other known means. Since the mesh 18 is flexible, the substrate 31 may be flat, circular, or other desired curved shape. The mesh 18 can be curved to fit the plate 31, and then welded or otherwise fixed to retain the shape. Alternatively, the mesh can be fixed to the substrate by the same material that holds the particles, so both steps are accomplished during the sintering process.

FIG. 8 shows another variation of tool made with the present invention. It is sometimes desirable to allow release space between abrasive portions, and this can be provided as desired with the structure of the present invention. The mesh 18 as shown in FIG. 7 may be cut to the desired shape and fixed into place to achieve the arrangement shown in FIG. 8. Also, the particles may be placed in the pattern shown, and urged into a mass of powder or fiber as discussed in conjunction with FIG. 1. A mesh may be used, particles being placed in selected openings of the mesh. In any case, the desired pattern can be created, and the resulting abrasive material can be fixed to a sanding disk or the like. From the above description it should also be obvious that the disk of FIG. 8 can be made like the product shown in FIG. 3. The mesh 18 would be circular, and selected openings would contain the particles 19.

Finally, with attention to FIG. 9 of the drawings, it will be realized that two or more pieces of abrasive material made in accordance with the present invention can be stacked, so a multiple layer tool can be made. Using this technique, one might use two of the devices shown in FIG. 2 or FIG. 3 and create a two-sided abrasive material. Many variations are possible, and FIG. 9 illustrates some of the variations.

In FIG. 9, the dashed lines indicate boundaries of the original layers that are used to create the multi-layer material. Thus, it will be noted that the outer layers 34 and 35 have closely spaced particles 36 and 38 on their outer sides. The next layers 39 and 40 have more widely spaced particles 41 and 42, which lie on the boundaries between the layers. The inner, center, layer 44 has widely spaced particles 45 which protrude from both sides, and are on the boundaries of the center and the next layers. It will be obvious that the layers can be bonded together by brazing completed layers, or by sintering unsintered layers, as desired.

While the arrangement shown in FIG. 9 is only by way of illustration, it will be readily understood by those skilled in the art that a saw can be made with this construction. The high concentration of particles at the outer edges of the material will slow the wear of the saw at the edges, while the low concentration of particles towards the center will increase the wear in the center. The result is that the cutting edge 46 will wear as a concave surface, causing the saw to run true.

In the foregoing discussion, the particles that provide the abrasive qualities may be any of numerous materials. Diamonds are often used for such tools, and the present invention is admirably suited to the use of diamonds; however, other materials can be used as desired. Tungsten carbide, cemented carbide, boron nitrite, silicon carbide, or aluminum oxide are usable as the abrasive particles, depending on the qualities desired.

While the present invention includes the concept of placing two or more particles in one opening of the mesh such as the mesh 18, the preferred form of the invention comprises the placing of the one particle in one opening. Even if more than one particle is placed in an opening, however, the particles may be of substantial size and do not have to be hand placed.

Those skilled in the art would now understand that the present invention provides a flexible carrier containing the desired concentration of diamonds or other hard particles, the particles being firmly held in the carrier by sintered metal powder or the like. The resulting product can be used singly, or can be layered to provide a tool having a varying concentration as desired. Also, since the carrier is flexible, the product of the present invention can be shaped to conform to the contour of intricately shaped substrates. Thus, form blocks can be made without the requirement for hand placing of diamonds and with the strength of diamonds held in a sintered material. The product of the present invention can therefore be utilized to provide routers, diamond rolls, and virtually any other shaped tool.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

We claim:

1. A method for producing an abrasive tool, wherein a plurality of particles is fixed to the tool, the particles providing the abrasive quality of the tool, said method including the steps of placing said plurality of particles on a flexible metallic mesh carrier and forcing said plurality of particles into said flexible metallic mesh carrier with said particles protruding from said flexible metallic mesh carrier on at least one side thereof, and for fixing said particles in said carrier.

2. A method as claimed in claim 1, said carrier comprising a preformed matrix of sinterable material, and wherein the said step of forcing said plurality of particles into said flexible carrier includes the step of mechanically forcing said particles into said preformed matrix, and subsequently sintering said carrier.

3. A method as claimed in claim 1, said carrier comprising a metallic mesh defining a plurality of openings therein, and wherein the said step of forcing said plurality of particles into said flexible carrier includes the step of placing one of said plurality of particles in each of said plurality of openings.

4. A method as claimed in claim 3, and further including the step of filling said plurality of openings in said mesh with a material after the said step of placing one of said plurality of particles in each one of said plurality of openings.

5. A method as claimed in claim 2, and further including the step of placing a mesh defining a plurality of openings therein on said carrier for defining a pattern on said carrier, and placing one particle of said plurality of particles in each opening of said plurality of openings.

6. A method as claimed in claim 5, and further including the step of forcing said particles and said mesh into said carrier, before the said step of sintering said carrier.

7. A method as claimed in claim 1, and including the step of conforming said flexible carrier to the shape of a substrate and fixing said carrier, with said particles therein, to said substrate.

8. A method as claimed in claim 7, wherein the said step of fixing said carrier to said substrate is carried out before the said step of sintering said carrier, and sinterable material is used to fix said carrier to said substrate.

9. A method as claimed in claim 7, wherein the said step of fixing said carrier to said substrate is carried out subsequent to the said step of sintering said carrier.

10. A method as claimed in claim 1, and including the steps of producing a plurality of said abrasive tools, and subsequently bonding said plurality of said abrasive tools together as a composite tool.

* * * * *

UNITED STATES PATENT AND TRADEMARK OFFICE

CERTIFICATE OF CORRECTION

PATENT NO. : B1 4,925,457

DATED : September 26, 1995

INVENTOR(S) : Peter T. deKok et al.

It is certified that error appears in the above-indentified patent and that said Letters Patent is hereby corrected as shown below:

Column 2, line 35, "wherein" should read --with--.

Signed and Sealed this

Twenty-first Day of November, 1995

Bruce Lehman

*Attest:*

BRUCE LEHMAN

*Attesting Officer*

*Commissioner of Patents and Trademarks*

US004925457B1

REEXAMINATION CERTIFICATE (2682th)

United States Patent [19] [11] B1 4,925,457 deKok et al. [45] Certificate Issued Sep. 26, 1995

[54] METHOD FOR MAKING AN ABRASIVE TOOL

[75] Inventors: Peter T. deKok; Naum N. Tselesin, both of Atlanta, Ga.

[73] Assignee: Ultimate Abrasive Systems, Inc., Atlanta, Ga.

Reexamination Request
No. 90/003,404, Apr. 18, 1994

Reexamination Certificate for:

| | |
|---|---|
| Patent No.: | **4,925,457** |
| Issued: | **May 15, 1990** |
| Appl. No.: | **303,924** |
| Filed: | **Jan. 30, 1989** |

[51] Int. Cl.[6] ..... B24D 3/02

[52] U.S. Cl. ..... 51/293; 51/295; 51/308; 51/309

[58] Field of Search ..... 51/293, 295, 308, 51/309

[56] References Cited

U.S. PATENT DOCUMENTS

| | | | |
|---|---|---|---|
| 2,268,663 | 1/1942 | Kuzmick | 51/206 |
| 2,811,960 | 2/1957 | Fessel | 125/15 |
| 2,867,086 | 3/1959 | Raymond | 51/298 |
| 3,127,715 | 4/1964 | Christensen | 51/206 |
| 3,276,852 | 10/1966 | Lemelson | 51/298 |
| 3,860,400 | 1/1975 | Prowse et al. | 51/293 |
| 4,680,199 | 7/1987 | Vontell et al. | 427/199 |
| 4,949,511 | 8/1990 | Endo et al. | 51/295 |

FOREIGN PATENT DOCUMENTS

| | | | |
|---|---|---|---|
| 0086086 | 8/1983 | European Pat. Off. | E21B 10/48 |
| 0294198 | 3/1994 | European Pat. Off. . | |
| 2029390 | 10/1970 | France | B24D 11/00 |
| 2565870 | 12/1985 | France | B23P 5/00 |

*Primary Examiner*—Deborah Jones

[57] ABSTRACT

An abrasive material is formed by uniformly spacing particles of diamond or other hard, abrasive material, on a flexible carrier, embedding the particles in the carrier, and fixing the particles to the carrier with the particles protruding from the carrier to perform the abrasive action. The particles can be distributed by placing them in the openings of a mesh; and, the mesh may be removed or may be a part of the carrier. Since the carrier is flexible, the carrier can be shaped to conform to substrates of complex shapes. A plurality of carriers having different concentrations can be bonded together to form tools having varying concentrations.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 56 to 68:

The present invention provides a flexible abrasive tool having particles of diamond or other hard substance arranged in a selected *or non-random* pattern and embedded in a carrier. The type of the particles and the size of the particles can be selected to yield the desired characteristics of the tool. The carrier may comprise known materials such as metal powders, metal fibers, or mixtures of metal powders and fibers; or, the carrier may comprise a wire mesh, a particle being placed within each opening of the mesh, or within selected openings of the mesh, and the particles are then fixed to the mesh. The carrier is flexible so that it can be shaped to conform to a given substrate.

*The present invention also provides a method for producing an abrasive tool, wherein a plurality of particles is fixed to the tool by a sintered matrix material, the particles providing the abrasive quality of the tool, said method including the steps of placing said plurality of particles in a non-random pattern into a plurality of openings of a flexible metallic mesh carrier, forcing said plurality of particles into said flexible metallic mesh carrier with said particles protruding from said flexible metallic mesh carrier on at least one side thereof, applying sinterable matrix material to said particles and then fixing said particles within said openings in said carrier with said sintered matrix material by sintering under pressure said sinterable matrix material applied to said particles. Alternatively, the flexible metallic mesh carrier can be a preformed matrix of sinterable material, into the openings of which the particles are placed, the preformed matrix then being subsequently sintered under pressure to fix the particles in the carrier.*

AS A RESULT OF REEXAMINATION, IT HAS BEEN DETERMINED THAT:

Claims 2 and 6 are cancelled.

Claims 1, 3–5 and 7–10 are determined to be patentable as amended.

New claims 11–16 are added and determined to be patentable.

1. A method for producing an abrasive tool, wherein a plurality of particles is fixed to the tool *by a sintered matrix material*, the particles providing the abrasive quality of the tool, said method including the steps of placing said plurality of particles [on] *in a non-random pattern into a plurality of openings of* a flexible metallic mesh carrier [and], forcing said plurality of particles into said flexible metallic mesh carrier with said particles protruding from said flexible metallic mesh carrier on at least one side thereof, *applying sinterable matrix material to said particles* and [for] *then* fixing said particles *within said openings* in said carrier *with said sintered matrix material by sintering under pressure said sinterable matrix material applied to said particles*.

3. A method as claimed in claim 1, [said carrier comprising a metallic mesh defining a plurality of openings therein, and] wherein the said step of [forcing] *placing* said plurality of particles into said flexible carrier includes [the step of] placing one of said plurality of particles in each of said plurality of openings.

4. A method as claimed in claim 3, [and further including the step of] *wherein the sinterable matrix material is applied to said particles by* filling said plurality of openings in said mesh with [a] *said sinterable matrix* material after the said step of placing one of said plurality of particles in each one of said plurality of openings.

5. A method as claimed in claim [2] *16*, [and further including the] *wherein the* step of placing [a mesh defining a plurality of openings therein on said carrier for defining a pattern on said carrier, and] *said plurality of particles into said preformed matrix includes* placing one particle of said plurality of particles in each [opening] of said plurality of openings.

7. A method as claimed in claim 1, [and] *further* including the step of conforming said flexible carrier to the shape of a substrate and fixing said carrier, wherein said particles therein, to said substrate.

8. A method as claimed in claim [7] *11*, wherein the said step of fixing said carrier to said substrate is carried out before the said step of sintering said carrier, and *the same* sinterable *matrix* material is used to fix said carrier to said substrate.

9. A method as claimed in claim [7] *11*, wherein the said step of fixing said carrier to said substrate is carried out subsequent to the said step of sintering said carrier.

10. A method as claimed in claim 1, [and] *further* including the steps of producing a plurality of said abrasive tools, and subsequent bonding said plurality of said abrasive tools together as a composite tool.

*11. A method as claimed in claim 16, further including the step of conforming said flexible carrier to the shape of a substrate and fixing said carrier, with said particles therein, to said substrate.*

*12. A method as claimed in claim 1, wherein the particles protrude from both sides of the carrier after sintering under pressure.*

*13. A method as claimed in claim 1, wherein two or more particles are placed in each of said plurality of openings of said carrier.*

*14. A method as claimed in claim 10, wherein the particles protrude from both sides of said composite tool.*

*15. A method as claimed in claim 10, wherein a high concentration of said particles is fixed at an outer edge of said composite tool and a lower concentration of said particles is fixed towards the center of said composite tool.*

*16. A method for producing an abrasive tool, wherein a plurality of particles is fixed to the tool by a sintered matrix material, the particles providing the abrasive quality of the*

*tool, said method including the steps of placing said plurality of particles in a non-random pattern into a plurality of openings of a flexible metallic mesh carrier comprising a preformed matrix of sinterable material, forcing said plurality of particles into said preformed matrix with said particles protruding from said preformed matrix on at least one side thereof, and fixing said particles within said openings in said preformed matrix by sintering under pressure said preformed matrix of sinterable material.*

* * * * *